US006814062B2

(12) United States Patent
Esteghlal et al.

(10) Patent No.: US 6,814,062 B2
(45) Date of Patent: Nov. 9, 2004

(54) METHOD FOR OPERATING AN INTERNAL COMBUSTION ENGINE

(75) Inventors: Gholamabas Esteghlal, Ludwigsburg (DE); Georg Mallebrein, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 82 days.

(21) Appl. No.: 10/297,365

(22) PCT Filed: May 15, 2001

(86) PCT No.: PCT/DE01/01837

§ 371 (c)(1),
(2), (4) Date: Dec. 4, 2002

(87) PCT Pub. No.: WO01/94771

PCT Pub. Date: Dec. 13, 2001

(65) Prior Publication Data

US 2003/0145837 A1 Aug. 7, 2003

(30) Foreign Application Priority Data

Jun. 8, 2000 (DE) ..... 100 28 539

(51) Int. Cl.[7] ..... F02M 33/02
(52) U.S. Cl. ..... 123/520; 123/516
(58) Field of Search ..... 123/520, 521, 123/518, 519, 516, 198 D

(56) References Cited

U.S. PATENT DOCUMENTS 5,125,385 A * 6/1992 Frinzel ..... 123/698
5,188,085 A * 2/1993 Habaguchi et al. ..... 123/520
5,216,995 A * 6/1993 Hosoda et al. ..... 123/520
5,259,353 A * 11/1993 Nakai et al. ..... 123/518
5,259,355 A * 11/1993 Nakashima et al. ..... 123/520
5,390,644 A * 2/1995 Nunogaki et al. ..... 123/520
5,476,081 A * 12/1995 Okawa et al. ..... 123/478
6,237,328 B1 * 5/2001 Kerns ..... 60/283

FOREIGN PATENT DOCUMENTS

| | | |
|---|---|---|
| DE | 38 13 220 A | 11/1989 |
| EP | 0 824 189 A | 2/1998 |
| EP | 0 890 718 A | 1/1999 |
| WO | 00 09881 A | 2/2000 |

* cited by examiner

*Primary Examiner*—Carl S. Miller
(74) *Attorney, Agent, or Firm*—Michael J. Striker

(57) ABSTRACT

A method of operating an internal combustion engine of a motor vehicle has the steps of injecting fuel into a combustion chamber in at least two operating types; flowing an air/fuel mixture through a tank ventilation valve and supplying the air/fuel mixture to the combustion chamber; generating an output signal by an integrator, which represents a specific desired fuel rate (fkastes) of the air/fuel mixture flowing through the tank ventilation valve, which is used to take into account respectively a current lambda on the engine; determining a desired fuel proportion (fkates) of the air/fuel mixture flowing through the tank ventilation valve, which represents the desired fuel proportion that should be supplied through the tank ventilation valve; comparing the specific desired fuel rate (fkastes) to the desired fuel proportion (fkates); conveying a comparison result back to the integrator; thereby regulating the specific desired fuel rate (fkastes) to the desired fuel proportion (fkates) of the air/fuel mixture flowing through the tank ventilation valve; also a computer program and a control unit is provided for the inventive method.

8 Claims, 2 Drawing Sheets

METHOD FOR OPERATING AN INTERNAL COMBUSTION ENGINE

BACKGROUND OF THE INVENTION

The invention relates to a method for operating an internal combustion engine, in particular of a motor vehicle, in which fuel is injected into a combustion chamber in at least two types of operation and in which an air/fuel mixture flows through a tank ventilating valve and is supplied to the combustion chamber. The invention also relates to a corresponding internal combustion engine and a control unit for such an engine.

A method, an engine, and a control unit of this kind are known, for example, from a so-called gasoline direct injection. In gasoline direct injection, fuel is injected into the combustion chamber of the engine in a homogeneous operation during the intake phase or in a stratified operation during the compression phase. The homogeneous operation is preferably provided for full load operation of the engine, whereas the stratified operation is suitable for idling operation and partial-load operation. The stratified operation is distinguished among other things by means of a motor operation with a surplus of air, i.e. a lean operation. In a direct injection of this kind, the operation is switched between the above-mentioned operation types depending on the operating parameters of the engine.

Operation types of the engine are also understood to mean the homogeneous operation with lambda equals one, a leaner homogeneous operation or homogeneous lean operation, and possibly still other operation types of the engine.

In engines of this kind, it is also known to provide a tank ventilation with which an air/fuel mixture from the fuel tank of the engine can be conveyed through a tank ventilation valve to the combustion chamber of the engine. Tank ventilation can be used to prevent unspent fuel from being emitted into the atmosphere.

The tank ventilation mentioned above must be incorporated into the entire control and/or regulation of the engine. To this end, it is particularly necessary to trigger the tank ventilation valve in such a way that on the one hand, the greatest possible ventilation of the fuel tank is achieved, but that on the other hand, this has no negative influence whatsoever on the pollutant emissions or on the torque desired by the driver of the motor vehicle.

SUMMARY OF THE INVENTION

The object of the invention is to produce a method for operating an internal combustion engine with which an optimal tank ventilation can be achieved.

In a method of the type mentioned at the beginning, this object is attained according to the invention by establishing a specific desired fuel rate of the air/fuel mixture flowing through the tank ventilation valve. The stated object is correspondingly attained according to the invention with an internal combustion engine and with a control unit for an engine of this kind.

Using the specific desired fuel rate of the air/fuel mixture flowing through the tank ventilation valve, a variable is produced, with which the respectively current lambda of the engine can be taken into account in the control and/or regulation of the tank ventilation. The tank ventilation can therefore be used not only with a lambda of 1, but also with any air/fuel ratio of the engine. It is therefore possible to use tank ventilation even in a direct-injecting internal combustion engine in which lambda can also not equal 1. The tank ventilation, in particular the triggering of the tank ventilation valve, is then executed based on this specific desired fuel rate.

To this end, it is particularly advantageous if the specific desired fuel rate is regulated to a desired fuel proportion of the air/fuel mixture flowing through the tank ventilation valve. The above-mentioned desired fuel proportion can be inferred in particular from a characteristic field that depends on operating parameters of the engine. The specific desired fuel rate can be weighted with a factor, which represents the charging of an activated charcoal filter that is contained in the fuel tank of the internal combustion engine.

It is also particularly advantageous if an integrator generates the specific desired fuel rate, if the specific desired fuel rate is compared to the desired fuel proportion, and if the comparison result is conveyed back to the integrator. As a result, in the final analysis, the comparison result is corrected by means of the integrator. The specific desired fuel rate is consequently regulated to the specific fuel proportion. As mentioned above, the specific desired fuel rate and therefore the entire above-described regulation can be used under all air/fuel conditions of the internal combustion engine. The known regulation is therefore not limited to a lambda equal to 1.

In an advantageous modification of the invention, a desired through flow factor of the air/fuel mixture flowing through the tank ventilation valve is generated and damped. The desired through flow factor approximately represents the quotient of the desired through flow and the maximal through flow. This desired through flow factor can in the end be used to trigger the tank ventilation valve. Damping the desired through flow factor assures that this factor cannot change abruptly in the positive direction. This achieves the fact that the tank ventilation valve can only open in a delayed fashion. This assures an altogether precise control and/or regulation of the engine takes place.

It is particularly advantageous if the desired through flow factor is generated by a positively fed-back integrator and if the desired through flow factor is limited by a maximal through flow factor. This maximal through flow factor can in particular be determined from the specific desired fuel rate. This achieves the fact that the desired through flow factor can only be opened in a delayed fashion, but can be shut off abruptly. This prevents an abrupt opening of the tank ventilation valve, but at the same time permits the tank ventilation valve to close abruptly.

In another advantageous modification of the invention, a desired mass flow through the tank ventilation valve is generated and damped. This once again achieves the fact that the desired mass flow cannot abruptly change in the positive direction. Therefore positive jumps are reliably prevented within the scope of the control and/or regulation of the entire internal combustion engine.

It is particularly advantageous if the desired through flow factor is converted into a maximal mass flow through the tank ventilation valve, if a positively fed-back integrator generates the desired mass flow, and if the desired mass flow is limited by the maximal mass flow. On the one hand, this achieves the fact that the desired mass flow can only be opened in a delayed fashion. On the other hand, however, it is possible for the desired mass flow to be reduced abruptly and therefore closed.

Particularly significant is the embodiment of the method according to the invention in the form of a computer program that is provided for the control unit of the internal combustion engine. The computer program can run on a computer of the control unit and is suited for carrying out the method according to the invention. In this instance, the invention is embodied by means of the computer program so that this computer program represents the invention in the same way as the method, which the computer program is suited for carrying out. The computer program can be stored in a flash memory. A microprocessor can be provided as the computer.

Other features, possible applications, and advantages of the invention ensue from the following description of exemplary embodiments of the invention, which are depicted in the drawings. All features, which are described or depicted, whether by themselves or in arbitrary combinations, represent subjects of the invention, independent of their combination in the claims or in their interdependency and independent of their formulation or depiction in the specification or in the drawings.

DESCRIPTION OF THE PREFERRED EMBODIMENT

Figure 1:
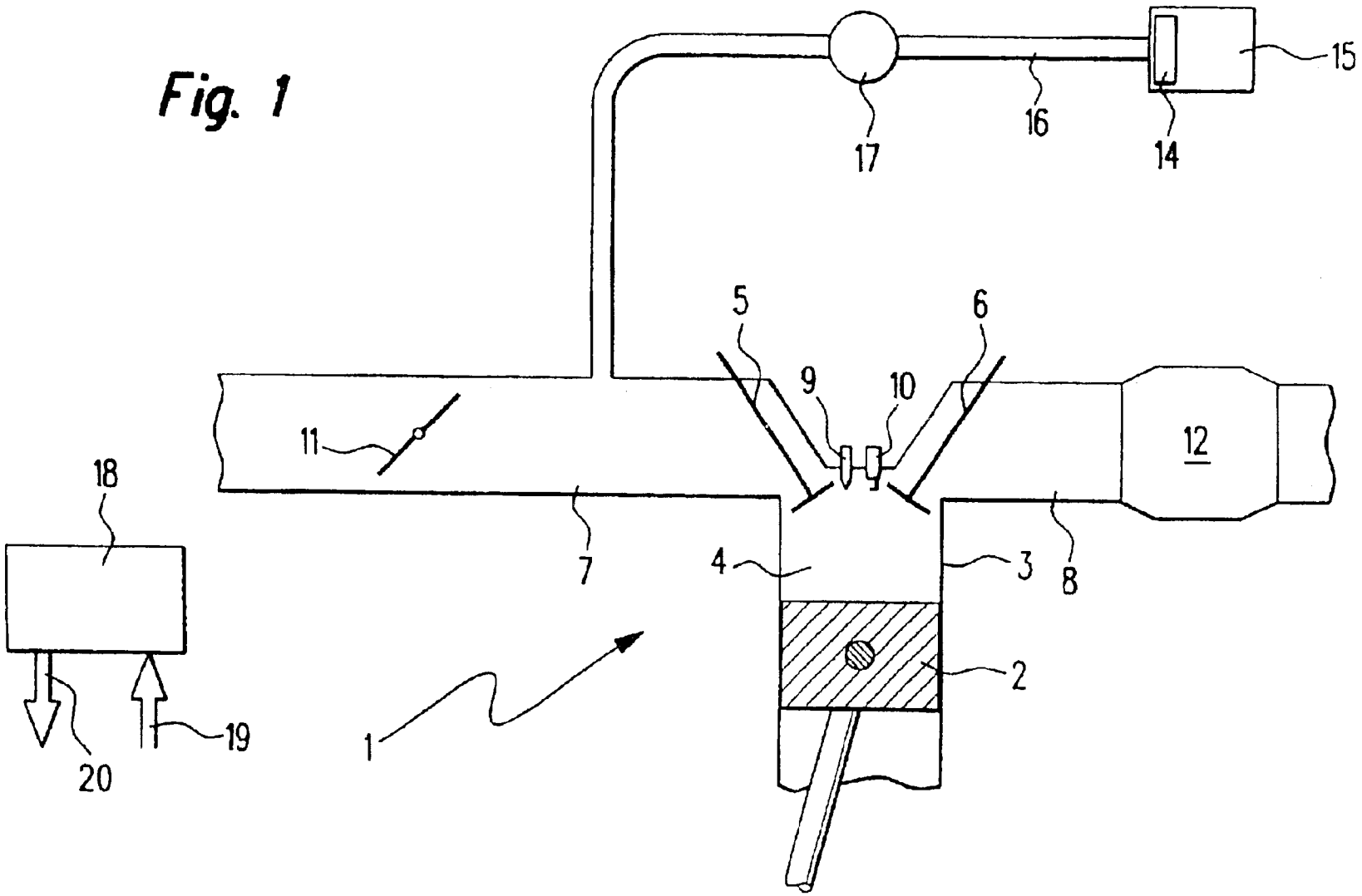
FIG. 1 shows a schematic block circuit diagram of an exemplary embodiment of an internal combustion engine according to the invention.

FIG. 1 shows an internal combustion engine 1 of a motor vehicle in which a piston 2 can move back and forth in a cylinder 3. The cylinder 3 is provided with a combustion chamber 4, which is delimited among other things by the piston 2, an inlet valve 5, and an outlet valve 6. The inlet valve 5 is coupled to an intake manifold 7 and the outlet valve 6 is coupled to an exhaust manifold 8.

In the vicinity of the inlet valve 5 and the outlet valve 6, an injection valve 9 and a spark plug 10 protrude into the combustion chamber 4. The injection valve 9 can inject fuel into the combustion chamber 4. The spark plug 10 can ignite the fuel in the combustion chamber 4.

A throttle valve 11 is accommodated so that it can rotate in the intake manifold 7 and can supply air into the intake manifold 7. The quantity of air supplied depends on the angular position of the throttle valve 11. The exhaust manifold 8 contains a catalytic converter 12, which is used to purify the exhaust gases produced by the combustion of the fuel.

A tank ventilation line 16 leads from an activated charcoal filter 14 of a fuel tank 15 to the intake manifold 7. The tank ventilation line 16 contains a tank ventilation valve 17 that can adjust the quantity of air/fuel mixture supplied to the intake manifold 7. The activated charcoal filter 14, the tank ventilation line 16, and the tank ventilation valve 17 constitute a so-called tank ventilation unit.

The combustion of the fuel in the combustion chamber 4 sets the piston 2 into a reciprocating motion, which is transmitted to a crankshaft, not shown, and exerts a torque on it.

A control unit 18 is acted on by input signals 19, which represent operating parameters of the engine 1 that are measured by means of sensors. For example, the control unit 18 is connected to an air mass sensor, a lambda sensor, a speed sensor, and the like. The control unit 18 is also connected to a gas pedal sensor, which generates a signal that indicates the position of a gas pedal that can be actuated by a driver and therefore indicates the desired torque. The control unit 18 generates output signals 20, which can be used to influence the behavior of the engine 1 by means of actuators or control elements. For example, the control unit 18 is connected to the injection valve 9, the spark plug 10, the throttle valve 11, and the like, and generates the signals required for activating them.

Among other things, the control unit 18 is provided to control and/or regulate the operating parameters of the engine 1. For example, the fuel mass injected into the combustion chamber 4 by the injection valve 9 is controlled and/or regulated by the control unit 18 in particular with regard to a low fuel consumption and/or a low pollutant emission. To this end, the control unit 18 is provided with a microprocessor, which has a program stored in a storage medium, in particular a flash memory, which program is suited for carrying out the above-mentioned control and/or regulation.

The internal combustion engine 1 in FIG. 1 can run in a number of types of operation. It is therefore possible to operate the engine 1 in a homogeneous operation, a stratified operation, a homogeneous lean operation, a stratified operation with a homogeneous basic charge, and the like.

In homogeneous operation, during the intake phase, the injection valve 9 injects the fuel directly into the combustion chamber 4 of the engine 1. The fuel is therefore to a large extent swirled until ignition so that an essentially homogeneous fuel/air mixture is produced in the combustion chamber 4. The moment to be produced is thereby essentially set by the control unit 18 through the position of the throttle valve 11. In homogeneous operation, the operating parameters of the engine 1 are controlled and/or regulated in such a way that lambda equals one. The homogeneous operation is particularly used under full load.

Homogeneous lean operation largely corresponds to homogeneous operation, but the lambda is set to a value greater than one.

In stratified operation, the injection valve 9 injects the fuel directly into the combustion chamber 4 of the internal combustion engine 1 during the compression phase. As a result, upon ignition by means of the spark plug 10, there is not a homogeneous mixture in the combustion chamber 4, but rather a stratification of fuel. Except for requirements, e.g. of tank ventilation, the throttle valve 11 can be completely opened and the internal combustion engine 1 can therefore be operated in an unthrottled fashion. In stratified operation, the moment to be produced is largely set by means of the fuel mass. The engine 1 can run in stratified operation particularly when idling or under partial load.

The engine 1 can be switched back and forth between the above-mentioned operation types depending on the operating parameters of the engine 1. This kind of switching back and forth is executed by means of the control unit 18. To this end, the control unit 18 contains a characteristic field of operation types in which an associated operation type is stored for each operating point of the engine 1.

The above-described tank ventilation unit must be incorporated into the overall control and/or regulation of the engine 1. A number of parameters of tank ventilation must be taken into account, such as the loading of the activated charcoal filter 14 with hydrocarbons, the position of the tank ventilation valve 17, the current operating state of the engine 1, in particular its current operation type, the torque desired by the driver, which is to be output by the engine 1, and the like. For this incorporation of the tank ventilation, it is necessary to determine a desired through flow factor (ftevflos) through the tank ventilation valve 17 as well as a desired mass flow (mstesoll) through the tank ventilation valve 17.

In conjunction with FIG. 2, a method will be explained below, which can be used to determine the above-mentioned desired through flow factor (ftevflos) and the above-mentioned desired mass flow (mstesoll).

Figure 2:
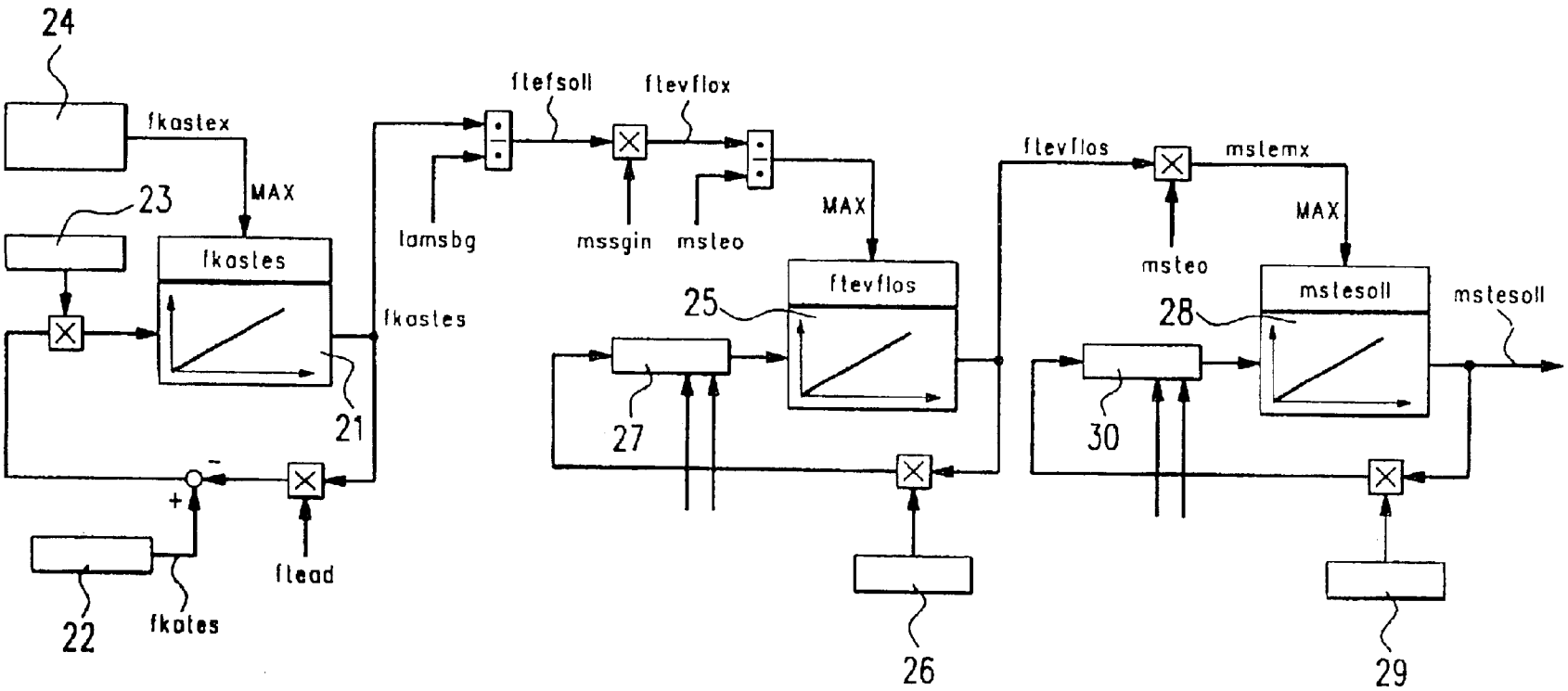
FIG. 2 shows a schematic block circuit diagram of an exemplary embodiment of a method according to the invention for operating the internal combustion engine in FIG. 1.

To this end, an integrator 21 is provided in FIG. 2, whose output signal represents a specific desired fuel rate (fkastes) of the tank ventilation unit. This specific desired fuel rate (fkastes) is multiplicatively concatenated with the loading (ftead) of the activated charcoal filter 14. The result of this multiplication is compared to a desired fuel proportion (fkates) of the tank ventilation. This desired fuel proportion (fkates) is determined by a block 22 and represents the desired fuel proportion that should be supplied by the tank ventilation.

The result of the above-mentioned comparison, possibly for correction or adaptation purposes, can also be concatenated with a factor that is supplied by a block 23. The resulting signal is then supplied to the integrator 21 as an input signal. Therefore in the end, the integrator 21 contains the above-mentioned comparison result, possibly in a weighted form.

A block 24 produces a maximal value (fkastex) for the specific fuel rate of the tank ventilation unit and supplies it to the integrator 21. This maximal value (fkastex) limits the output signal of the integrator 21, i.e. the specific desired fuel rate (fkastes) of the tank ventilation unit.

The integrator 21 with the associated feedback loop represents a control loop with which the specific desired fuel rate (fkastes) is regulated to the desired fuel proportion fkates of the tank ventilation unit. The integrator 21 of this control loop is thereby limited to the maximal value fkastex of the specific fuel rate for the tank ventilation unit.

The output signal of the above-mentioned control loop, i.e. the specific desired fuel rate fkastes is converted into a maximal through flow factor ftevflox through the tank ventilation valve 17. To this end, first the specific desired fuel rate fkastes is divided by the lambda desired value lamsbg. The resulting desired scavenging rate ftefsoll is multiplied by the entire mass flow mssgin in the intake manifold 7. The resulting mass flow is then divided by the mass flow (msteo) that occurs when the tank ventilation valve 17 is open. The result of this step is the above-mentioned maximal value for the through flow factor ftevflox through the tank ventilation valve 17.

The maximal value ftevflox for the through flow factor through the tank ventilation valve 17 is supplied to an integrator 25 and limits its output signal. This output signal of the integrator 25 is the desired through flow factor ftevflos through the tank ventilation valve 17. This desired through flow factor ftevflos is fed back to the input of the integrator 25. In this feedback loop, a multiplication by a correction factor or other factor can be executed, which is produced by a block 26. It is also possible that the feedback loop includes a further concatenation with operating parameters of the engine in a block 27.

The desired through flow factor ftevflos generated by the integrator 25 is multiplicatively concatenated with the mass flow msteo that occurs when the tank ventilation valve 17 is open. The result of this multiplication represents a maximal mass flow mstemx through the tank ventilation valve 17. This maximal mass flow mstemx is supplied as a maximal value to another integrator 28.

As an output signal, the integrator 28 generates the desired mass flow mstesoll through the tank ventilation valve 17. This desired mass flow mstesoll is fed back to the input of the integrator 28. It is thereby possible for the desired mass flow mstesoll to be multiplicatively concatenated with a factor, this factor being generated by a block 29. It is also possible for other operating parameters of the engine 1 to be taken into account in the feedback loop by means of a block 30.

The output signal of the integrator 28, i.e. the desired mass flow mstesoll is thereby limited to the maximal value mstemx of the mass flow through the tank ventilation valve 17.

Both of the integrators 25 and 28 are positively fed-back via their respective feedback loops. This means that the two integrators 25 and 28 always have the tendency to increase their output signal. The slope of such an increase of the respective output signal is a function of the feedback loop and in particular of influences on the feedback signal. The above-mentioned slope can consequently be set to desired values by means of the blocks 26, 27 and by means of the blocks 29, 30.

At the same time, the two integrators 25, 28 are each limited by a maximal value. This means that the output signal of the two integrators 25, 28 on the one hand is always increasing, but on the other hand, is always limited by the respectively applicable maximal value.

This results in the fact that the two integrators 25, 28, together with their feedback loops, function as damping elements. The output signals of the two integrators 25, 28 can on the one hand change in the direction of greater values, wherein—as mentioned above—the slope of this change can be set, but on the other hand, the output signals of these two integrators 25, 28 are limited by the respective maximal values so that a reduction of the maximal values also leads immediately and directly to a reduction of the respective output signal of the associated integrator 25, 28.

In other words, this means that the output signals of the two integrators 25, 28 in the opening up toward greater values, are provided with a limitation of the opening speed, but in the closing down toward lower values, there is no such speed limitation, so that the closing occurs abruptly without delay.

As mentioned above, the output signal of the integrator 25 is the desired through flow factor ftevflos for the tank ventilation valve 17. This desired through flow factor ftevflox is finally used to trigger the tank ventilation valve 17. This means that the tank ventilation valve 17 cannot be opened abruptly, but rather that during the opening of the tank ventilation valve 17 in the direction toward a greater through flow, the above-mentioned speed limitation applies. At the same time, however, it is possible for the tank ventilation valve 17 to close without delay and therefore abruptly. As has been explained above, no speed limitation applies in such a closing of the tank ventilation valve 17.

As has also been explained above, the output signal of the integrator 28 is the desired mass flow mstesoll through the tank ventilation valve 17. This desired mass flow mstesoll therefore cannot change abruptly. Instead, the opening of the desired mass flow mstesoll can only occur with the above-mentioned speed limitation. By contrast, however, it is possible to close the desired mass flow mstesoll abruptly and therefore without delay. No speed limitation applies in this instance.

In summary, therefore, the first integrator 21 is used to execute a regulation of the specific desired fuel rate fkastes.

The second integrator 25 is used to derive a damped desired through flow factor ftevflos from the specific desired fuel rate fkastes. Finally, the third integrator 28 is used to determine a damped desired mass flow mstesoll from the desired through flow factor ftevflos. This overall method can be used for any lambda. The air/fuel ratio is taken into account by the desired lambda in the above-described method.

What is claimed is:

1. A method of operating an internal combustion engine of a motor vehicle, comprising the steps of injecting fuel into a combustion chamber in at least two operating types; flowing an air/fuel mixture through a tank ventilation valve and supplying the air/fuel mixture to the combustion chamber; generating an output signal by an integrator, which represents a specific desired fuel rate of the air/fuel mixture flowing through the tank ventilation valve, which is used to take into account respectively a current lambda on the engine; determining a desired fuel proportion of the air/fuel mixture flowing through the tank ventilation valve, which represents the desired fuel proportion that should be supplied through the tank ventilation valve; comparing the specific desired fuel rate to the desired fuel proportion; conveying a comparison result back to the integrator; thereby regulating the specific desired fuel rate to the desired fuel proportion of the air/fuel mixture flowing through the tank ventilation valve.

2. A method as defined in claim 1; and further comprising limiting the specific desired fuel rate to a maximum value for the specific fuel rate.

3. A method as defined in claim 1; and further comprising converting the specific desired fuel rate into a maximum through flow factor of the air/fuel mixture flowing through the tank ventilation valve.

4. A method as defined in claim 1; and further comprising generating and damping a desired through flow factor of the air/fuel flowing through the tank ventilation valve.

5. A method as defined in claim 1; and further comprising generating a positively fed-back integrator the desired throughflow factor; and limiting the desired throughflow factor by a maximum throughflow factor.

6. A method as defined in claim 1; and further comprising generating and damping a desired mass flow through the tank ventilation valve.

7. A method as defined in claim 1; and further comprising converting a desired throughflow factor into a maximum flow through the tank ventilation valve; simulating a desired mass flow by a positively fed-back integrator; and limiting the desired mass flow by a maximum mass flow.

8. A control unit for an internal combustion engine of a motor vehicle, in which fuel is injectable into a combustion engine in at least two operation types and in which an air/fuel mixture is flowable through a tank ventilation valve and supplyable to a combustion chamber, the control unit is formed so that it is used to determine a specific desired fuel rate for the air/fuel mixture flowing through the tank ventilation valve, which represents the desired fuel proportion that should be supplied through the tank ventilation valve, wherein the specific desired fuel rate is compared to a desired fuel proportion, wherein a comparison result is conveyed back to an integrator, whereby the specific desired fuel rate is regulated to a desired fuel proportion of the air/fuel mixture flowing through the tank ventilation valve.

* * * * *